United States Patent [19]

McKay et al.

[11] 4,451,728

[45] May 29, 1984

[54] SELF-CONTAINED PORTABLE VOTING BOOTH APPARATUS

[75] Inventors: Richard H. McKay, Chicago; Geoffrey R. Ryan, Glen Ellyn, both of Ill.

[73] Assignee: Frank Thornber Co., Chicago, Ill.

[21] Appl. No.: 344,628

[22] Filed: Feb. 1, 1982

[51] Int. Cl.[3] ..... G07C 13/00

[52] U.S. Cl. ..... 235/50 R; 312/223; 312/244; 312/258

[58] Field of Search ..... 255/51, 57; 312/223, 312/244, 258; 108/23, 36, 38, 60; 206/560, 232

[56] References Cited

U.S. PATENT DOCUMENTS

| | | | |
|---|---|---|---|
| 869,614 | 10/1907 | Bennett | 206/560 X |
| 3,333,766 | 8/1967 | Crossland et al. | 312/258 X |
| 3,389,947 | 6/1968 | Kelley et al. | 312/258 |
| 3,550,540 | 12/1970 | Albrecht et al. | 312/258 X |
| 3,620,587 | 11/1971 | Ahmann | 312/203 |
| 3,806,219 | 4/1974 | Ahmann | 312/223 |

*Primary Examiner*—Benjamin R. Fuller
*Attorney, Agent, or Firm*—Balogh, Osann, Kramer, Dvorak, Genova & Traub

[57] ABSTRACT

Apparatus is a carrying case, with integral top and bottom case sections. The bottom case section has a working surface for supporting a paper ballot or for pivotably securing a tray for receiving a vote recording device. A latch member secures the recording device on the tray. The bottom case section has a depressed well which externally stores erectable leg members which are integrally connected by an elastic cord to the case section. The top case section has a door which provides access to the recording device or other voting paraphernalia during the stored condition of the apparatus. The access door supports a light fixture internally provided with a test circuit which permits the light fixture to be tested when the apparatus is in stored condition. A defective light or light fixture can be readily removed by opening the access door. The latch member on the tray may be locked to prevent removal of the recording device. The access door has a locking tab which can be locked to the bottom case section. A pair of privacy side panels are integrally connected to the carrying case and maintained in upright position through a snap engagement with the top case section. Additional privacy may be obtained with an assembly having a generally "U"-shaped curtain rod having its ends insertable in channels provided in the side panels and at least one curtain panel supported by the rod. Each leg member is insertable into a socket defined by a partially molded structure, a yieldable molded socket insert and a yieldable molded corner insert to yieldably receive the leg member.

49 Claims, 19 Drawing Figures

FIG. 3
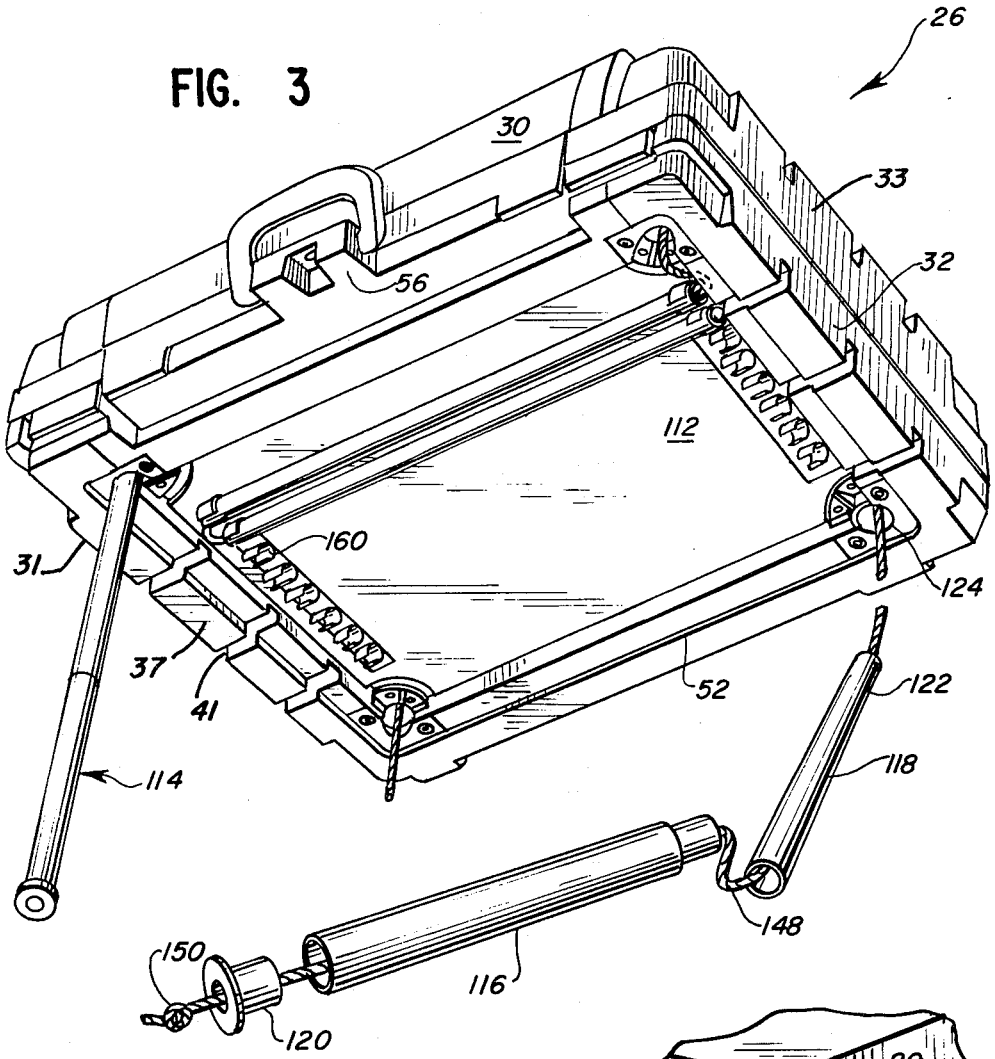
FIG. 4
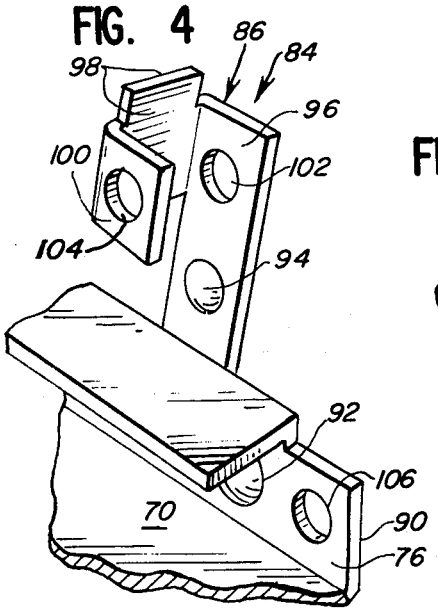
FIG. 5
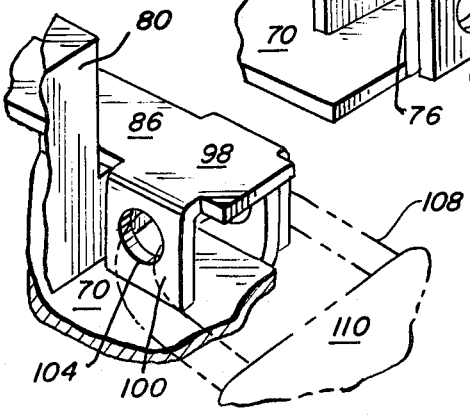
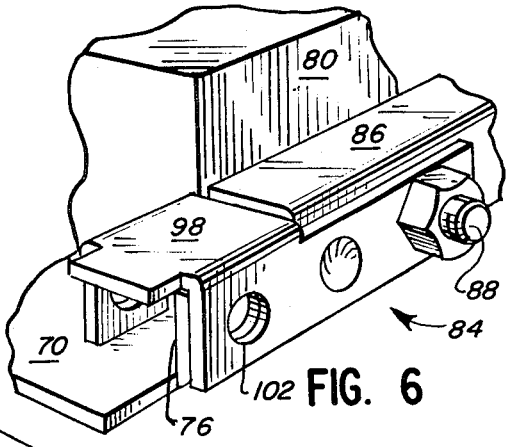
FIG. 6

FIG. 8
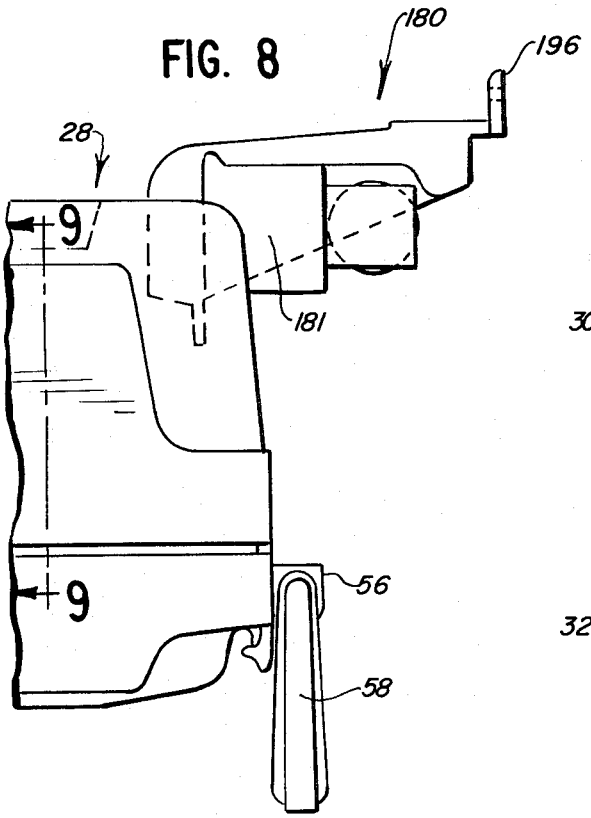
FIG. 9
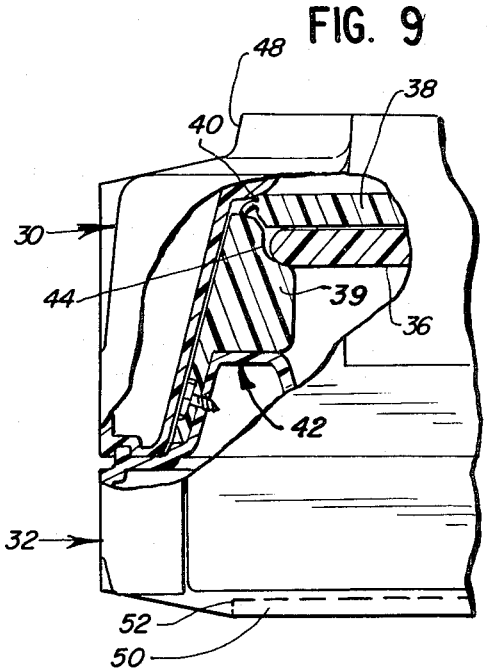
FIG. 10
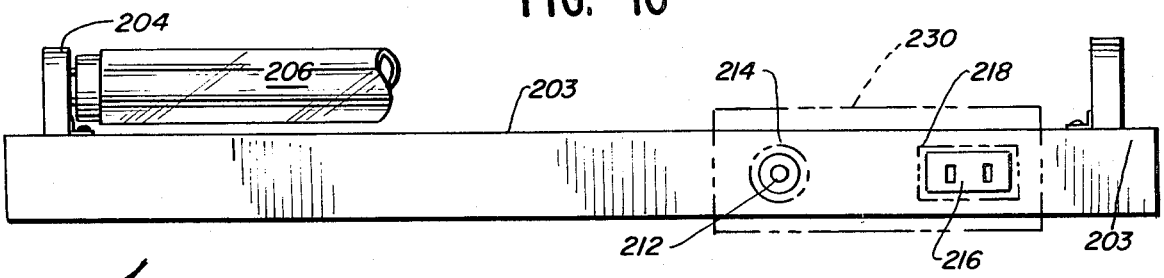
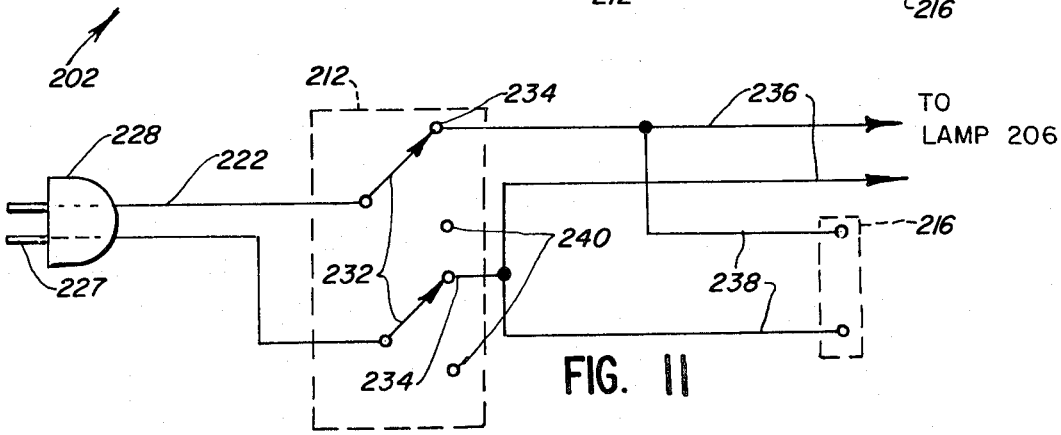
FIG. 11

FIG. 12
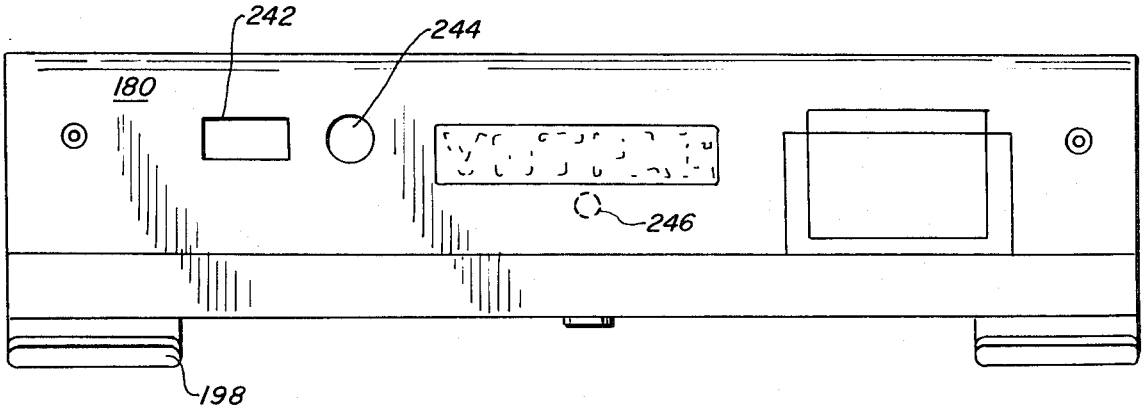
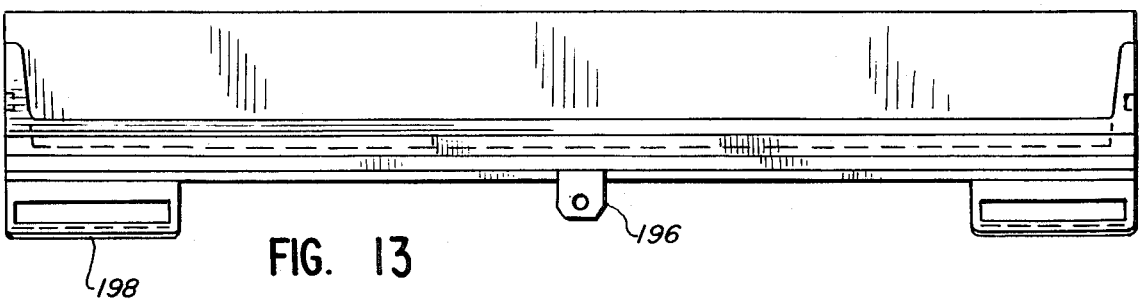
FIG. 13
FIG. 14
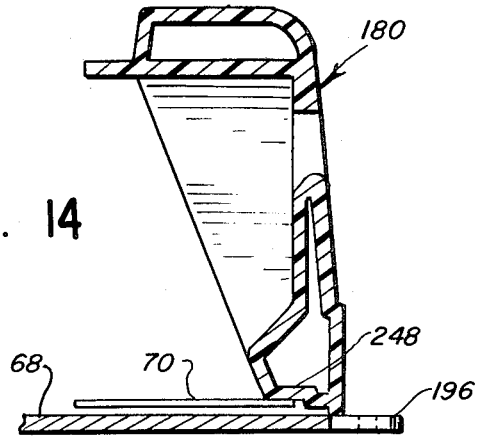

FIG. 15
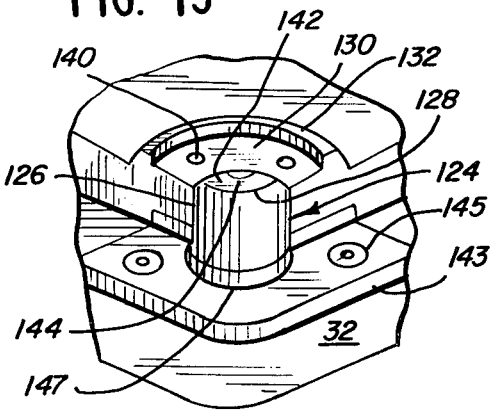
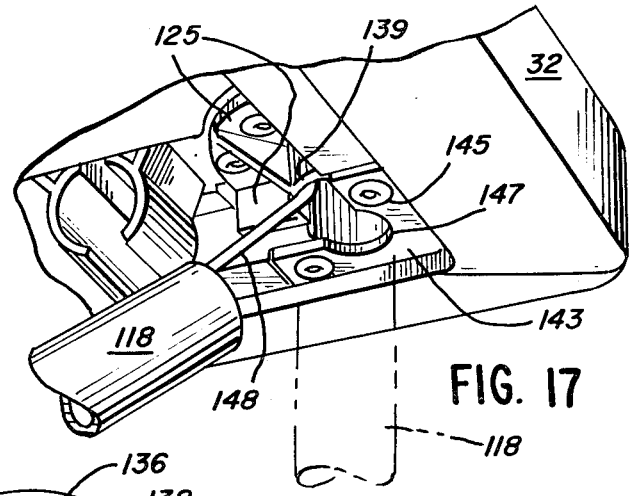
FIG. 17
FIG. 16A
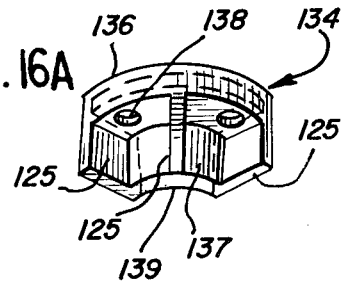
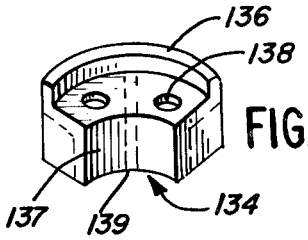
FIG. 16B
FIG. 18
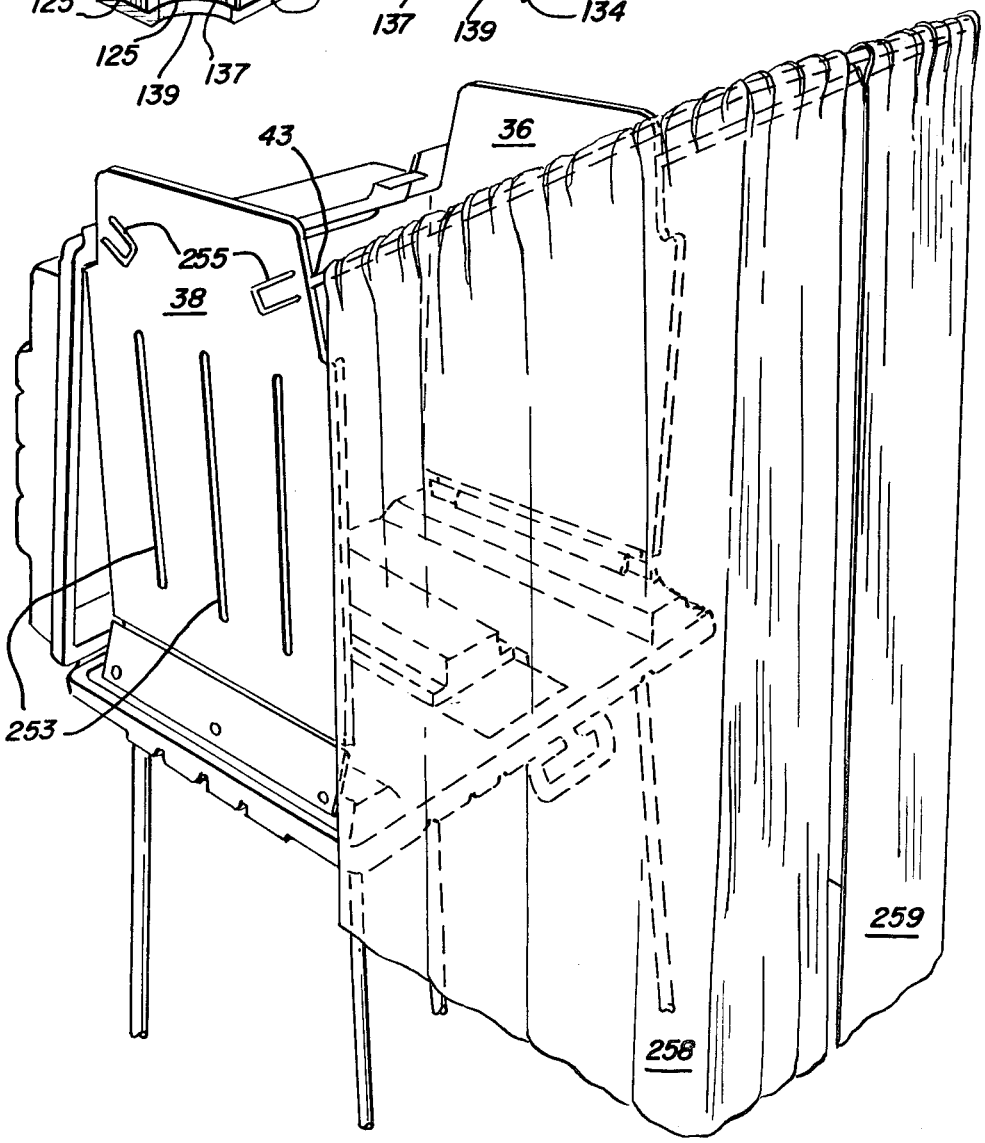

SELF-CONTAINED PORTABLE VOTING BOOTH APPARATUS

BACKGROUND OF THE INVENTION

1. Field of the Invention

This invention relates generally to voting booths used for balloting during elections and, more particularly, to a self-contained multi-purpose portable voting booth which, during a stored condition, has all components contained in a carrying case. More particularly, the multi-purpose voting booth can be used for paper balloting or balloting with vote recording devices, irrespective of the different sizes of the vote recording devices.

2. Description of the Prior Art

Since elections occur only occasionally, various forms of voting booths have been designed to be portable and to ensure privacy during balloting. Most of the known voting booths are portable and dismantable so that the booths can be stored in a compact manner until the next election. The present invention is concerned with a portable type of a voting booth apparatus which is self-contained in a carrying case. One type of such self-contained voting booth apparatus is described in U.S. Pat. No. 3,550,540, wherein a large folding table is used to support several booths which are partitioned from each other by appropriate side panels. The assembly of the components of this type of voting booth apparatus is cumbersome and is prone to loss of the components during assembly or disassembly. Another form of a portable voting booth is described in U.S. Pat. No. 3,806,219, wherein a carrying case is provided with top and bottom case sections. Panels which provide privacy during balloting and foldable legs are stored on the interior of the case. Although this known type of the voting booth apparatus, after it is assembled, serves its function of providing privacy during balloting, there are several disadvantages. The components comprising the voting booth apparatus, such as the foldable legs, are independent of the case and are prone to be lost during disassembly. Furthermore, in order to erect this known type of voting booth apparatus, it is necessary to place the case on the floor or on a table so that it can be opened up to take out the folded legs so that they can be erected and inserted into the bottom of the case. Another disadvantage of this known type of voting booth is the inability to gain access to the interior of the booth in its stored condition.

SUMMARY OF THE INVENTION

A storable-erectable portable voting booth apparatus is a self-contained unit embodied in a carrying case comprising a top case section and a bottom case section. One side of the top case section is provided with an access door to permit the insertion or the removal of a vote recording device while the apparatus is in a stored condition. The bottom case section integrally supports a pair of side panels for ensuring privacy during balloting. The top and the bottom case sections, are an integrally molded unit. The bottom case section has a working surface for supporting a paper ballot. The working surface is also provided with a pivotally supported tray which is adapted to receive a vote recording device. The trays may be interchanged so that vote recording devices having different configurations may be used with the voting booth apparatus. The bottom of the bottom case section is provided with a storage well for externally storing collapsible leg members which have hollow interiors for the introduction therethrough of an elastic cord which permanently secures the leg members to the bottom case section and retains the leg members in leg sockets when the voting booth apparatus is set-up. The various components as described up to this point are all permanently coupled together, thereby avoiding any loss of any of the components. The tray is provided with a latch member for securing the vote recording device on the tray. The latch member is also provided with means for locking the vote recording device on the tray. The access door, which is pivotally supported by the top case section, functions not only to provide access to the interior of the case, but also to support a light fixture providing a light source usable during the balloting process. The light fixture and the access door are arranged to provide an access for electrical testing of the light fixture while the access door is closed and the voting booth apparatus is in stored condition. Further, the access door is provided with a locking tab which can be secured to a portion of the bottom case section to prevent unauthorized intrusion into the interior of the case. Since some voting districts insist on more privacy than can be afforded by the side panels, a privacy assembly, readily attachable to the voting booth apparatus, is provided so that curtains extending beyond the side panels can be affixed.

The light fixture is provided with an internal test circuit so that the condition of the light source can be tested while the voting booth apparatus is in a stored and stacked condition.

The primary objective of the invention is a self-contained voting booth apparatus having components integrally associated with a carrying case.

Another primary objective of the invention is to provide a voting booth carrying use having a bottom case section provided with surface means for supporting a paper ballot and securing a vote recording device.

A further object of the invention is to provide a carrying case having a bottom case section incorporating a depressed planar wall, the upper surface of said wall defining surface means for supporting a paper ballot and securing a vote recording device and a lower surface defining a bottom of a well adapted to store leg means exteriorly of the carrying case.

Another object of the invention is to provide a voting booth apparatus having a working surface for accepting a paper ballot and also provided with a pivotable tray which can be rested on the working surface to support a vote recording device.

A further object of the invention is to provide a tray means for supporting a vote recording device, the tray means being pivotable to a non-use position during paper balloting.

An additional object of the invention is to provide a tray means for supporting a vote recording device and means for locking the device to prevent its unauthorized removal from the tray means.

Another object of the invention is to provide a voting booth apparatus self-contained in a carrying case having means for externally storing integrally attached leg means having leg members so that the voting booth apparatus can be erected promptly.

A further object of the invention is to provide leg means receiving and positioning means which facilitate the insertion of leg members and apply compressive force to the leg members to maintain them in rigidified positions.

A further object of the invention is to provide a carrying case having a lower case position provided with novel sockets for receiving round leg members, the sockets being conformed by a number of resiliently arranged components defining a leg receiving opening which is diametrically smaller than the leg member.

A further object of the invention is to provide a carrying case provided with an access door so that a vote recording device can be removed or inserted into the interior of the case while it is in a stored condition in a stack of cases.

A still further object of the invention is to provide an access door provided with a light fixture which can be tested while the access door is closed, and which fixture can be replaced, if defective, when the access door is opened.

Another object of the invention is to provide an access door which has a locking tab which can be locked so that the top and bottom case sections of the apparatus are locked together.

A still further object of the invention is to provide a voting booth apparatus having a privacy assembly including curtains which can be detachably secured to provide additional privacy during balloting.

These and other objects of this invention will become apparent from a study of the following description in which reference is directed to the attached drawings.

BRIEF DESCRIPTION OF THE DRAWINGS

The invention will now be described in detail in reference to the following drawings:

FIG. 3 is a perspective view of the bottom of the carrying case illustrating the erection of foldable legs;

FIG. 4 is a perspective view of a latch assembly on a tray, in an opened position, so that a vote recording device may be positioned on the tray;

FIG. 5 is a perspective view of the latch assembly shown in a closed position for securing the vote recording device;

FIG. 6 is another perspective view of the latch assembly showing its pivotal engagement with the tray;

FIG. 8 is a partial side view of the carrying case to which is secured a handle and showing the access door in an opened position to permit the insertion of the vote recording device as shown in FIG. 2;

FIG. 9 is a partial sectional view along the lines 9—9 in FIG. 8 to show a hinge connection between the carrying case and the privacy side panels;

FIG. 10 is a side view of a light fixture including a fluorescent lamp and providing illumination for the voting booth apparatus;

FIG. 11 is a circuit diagram embodied in the light fixture;

FIG. 12 is a front view of the access door;

FIG. 13 is a top view of the access door;

FIG. 14 is a sectional view of the access door shown in a latched position;

FIG. 15 is a partial view of one of the corners in the lower case section having a molded construction defining a partially molded socket for receiving a leg;

FIGS. 16A and 16B illustrate two views of a molded leg socket insert for further completing the leg socket shown in FIG. 15;

FIG. 17 is an enlarged view of a leg receiving and positioning structure; and FIG. 18 shows an erected voting booth apparatus showing a combination of privacy side panels and an additional privacy assembly.

DESCRIPTION OF THE PREFERRED EMBODIMENT

Figure 1:
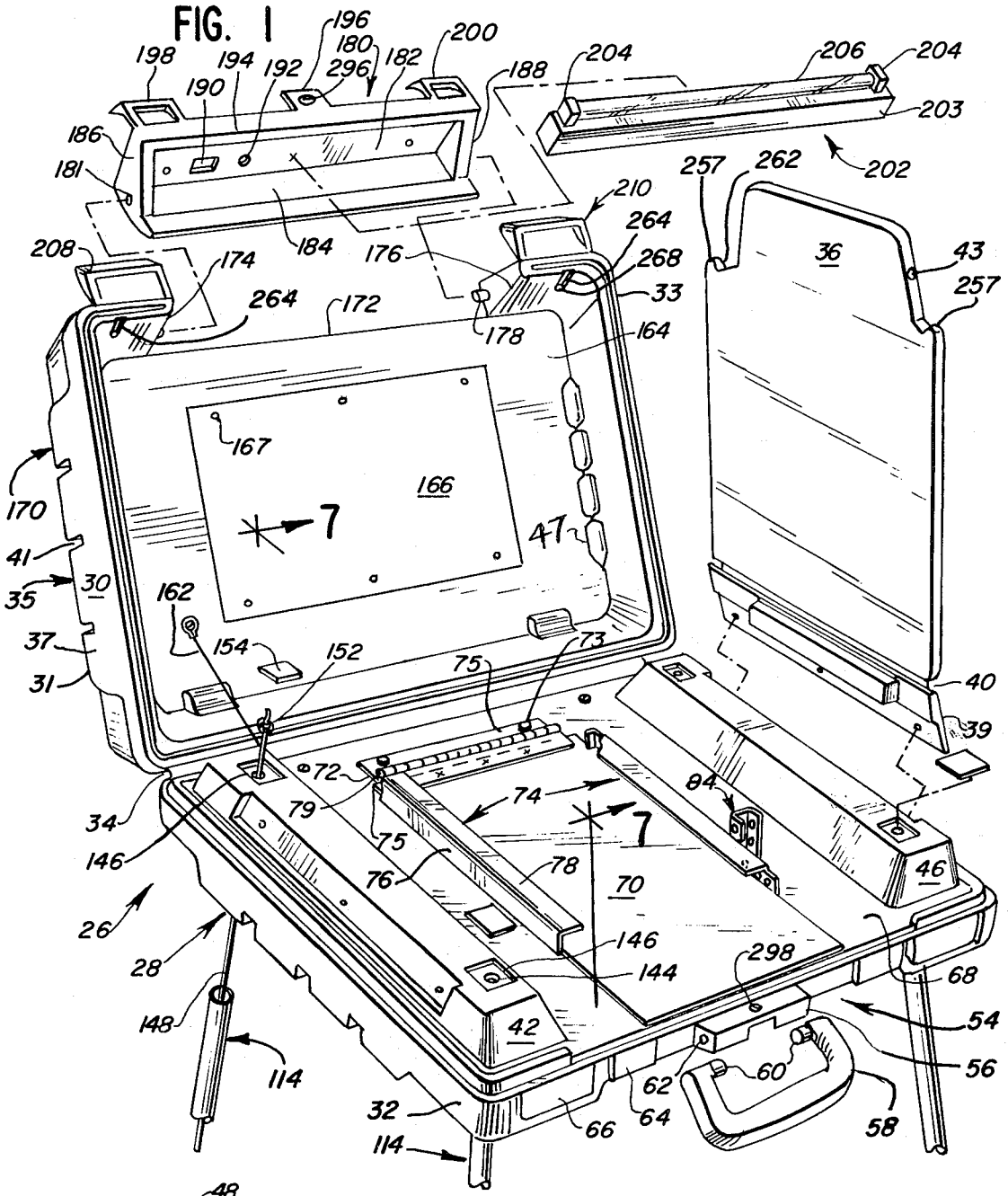
FIG. 1 is an exploded view of a self-contained portable voting booth apparatus embodied in a carrying case which has been opened up and set up for use.

The self-contained portable voting booth apparatus will now be generally discussed in reference to FIGS. 1, 2, 3, and 7. More specific details of the construction of the apparatus will be later described in reference to the remaining Figures.

A voting booth apparatus 26 comprises a carrying case 28 defined by a top case section 30 and a bottom case section 32, both of the case sections being joined by an integrally formed hinge 34. Preferably, the top case section 30 and the bottom case section 32 are blow molded in a single mold to provide an integral unit. Of course, it is apparent that the case sections can be molded separately and then coupled together by an independent hinge.

Extending from the bottom case section 32 is a pair of privacy side panels 36 and 38. For example, the privacy side panel 36 is coupled to a support member 39 by a hinge 40, all of the foregoing preferably being integrally molded. The support members 39 in turn are mounted on bulwark sections 42, 46 which are integrally molded with the bottom case section 32. Each of the privacy side panels, such as panel 36, is provided with a channel 43 for receiving a "U"-shaped curtain rod 45. The details of the hinge 40 are more clearly seen in the partial sectional view shown in FIG. 9, wherein the bottom case section 32 has the bulwark section 42 integrally connected with the panel 38 by the hinge 40. Each bulwark section such as section 42 is provided with an arcuate depression 44 to accommodate the side panel 36 in the stored condition. The privacy side panel 36 is similarly connected to the bulwark section 46 by an integrally formed hinge (not shown).

Figure 7:
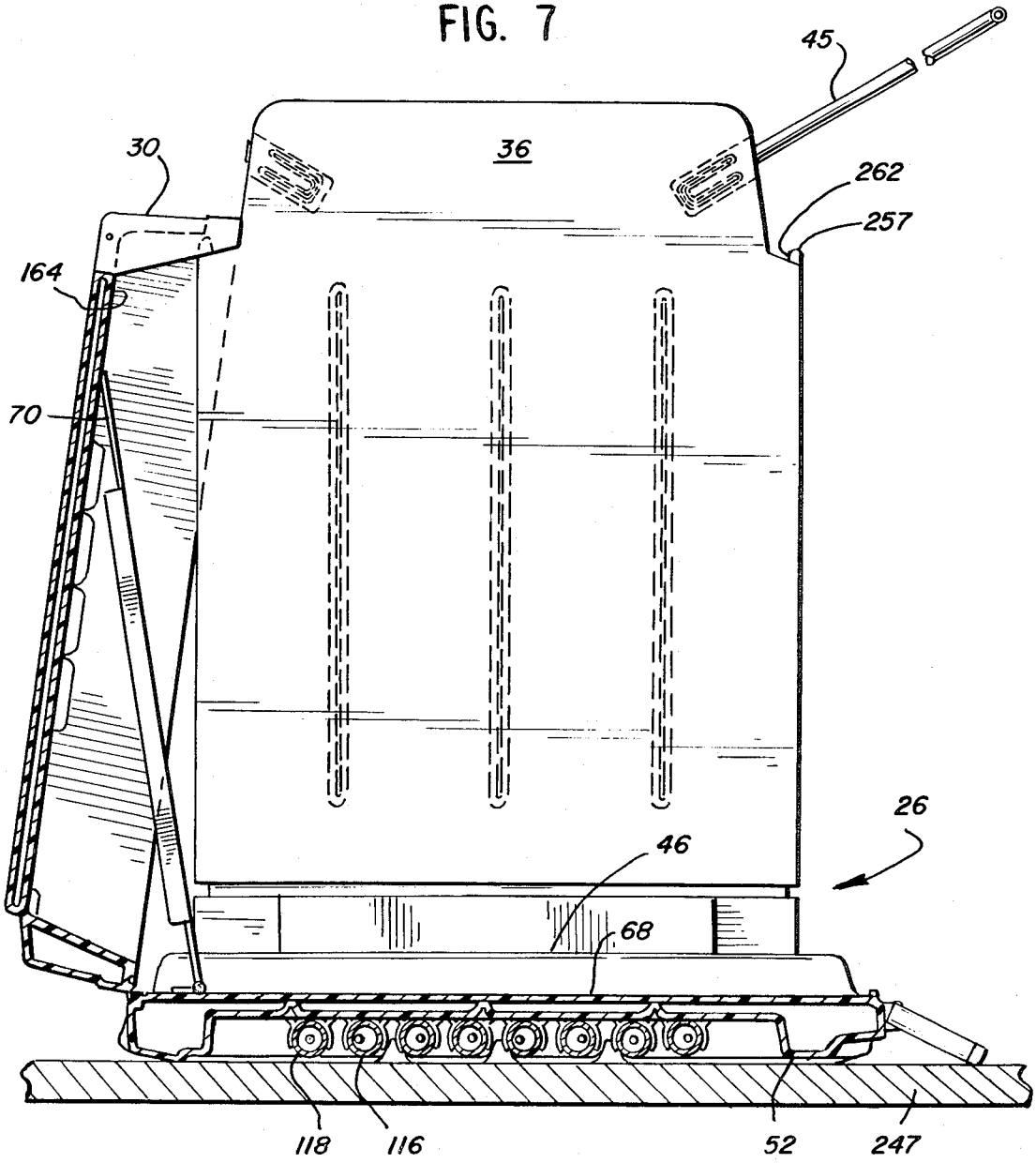
FIG. 7 is a sectional view taken along lines 7—7 of FIG. 1 showing a voting booth apparatus set-up on a table top with privacy side panels in erected positions and supporting an upwardly angled curtain rod.

As best shown in FIG. 9, the top case section 30 has a planar protuberance 48 and the bottom case section 32 is provided with a well 50 defined by a perimeter wall 52, as shown in FIGS. 3, 7, and 9. The well 50 is adapted to receive the planar protuberance 48 of another carrying case such as case 28*a*, as particularly illustrated in FIG. 2, which shows a stack of carrying cases mounted upon each other.

The bottom case section 32 has a front wall 54 provided with a centrally located handle mounting bracket 56 adapted to receive a carrying handle 58 which has pivot members 60 engagable with pivot holes 62 in the bracket 56. The front wall 54 is also provided with a pair of access door latch brackets 64 and a pair of carrying case latch brackets 66.

Figure 2:
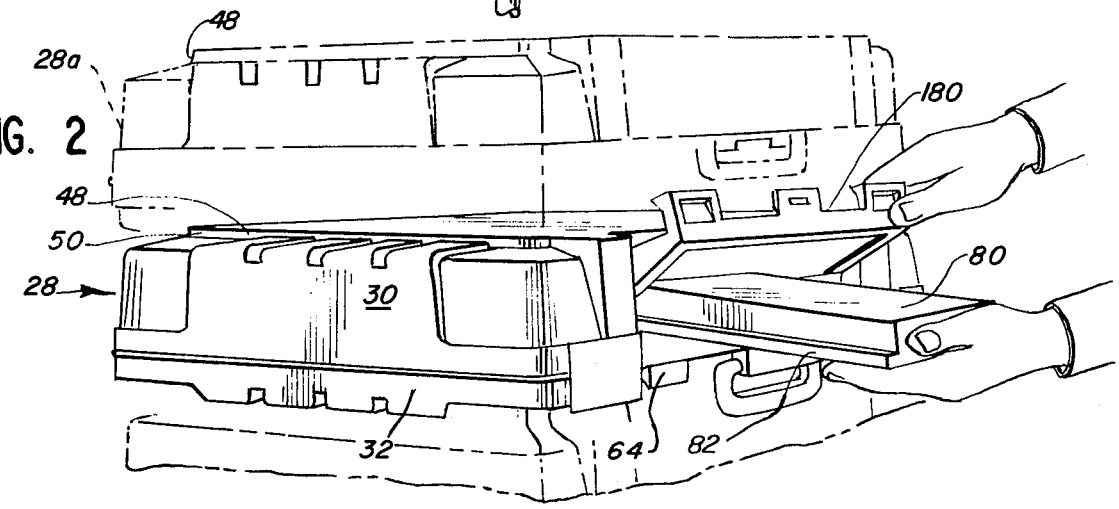
FIG. 2 is a perspective of the carrying case in a stored condition in a stack of other voting booth apparatus, showing how access to the interior of the case is obtained by means of an access door.

The bottom case section 32 is provided with a surface means as embodied by a working surface 68 which may be used by a voter to mark up a paper ballot. The working surface 68 pivotally supports securing means such as a tray 70 by pivotal means such as a hinge 72. The hinge 72 is secured by members 73 to the working surface 68. The tray 70 is provided with fore-shortened mounting means 74 having a pair of vertical walls 76 terminating in horizontally disposed flanges 78. The partial enclosure formed by the vertical walls 76 and flanges 78 is adapted to receive a vote recording device 80, which as shown in FIG. 2, has a mounting projection rib 82 extending along each side of the vote recording device. As is apparent, the vote recording device 80 is held in place on the tray 70 by the cooperative engagement between the projection ribs 82 and the flanges 78. Alternately, the tray 70 may be pivotally secured to the top case section 30 by appropriate means.

At this point, it is desirable to mention that all of the vote recording devices presently available are similarly constructed, that is, they have a body provided on each longitudinal side thereof with a mounting projection rib. The variations that exist in the presently available vote recording devices are in the configuration of the body. In order to accommodate the different configurations of the available vote recording devices, the present apparatus can be furnished with trays 70 having appropriate rib and flange configurations. The hinge 72 is secured to the working surface 68. Another (wider or narrower) tray 70 with its attendant hinge 72 can readily replace an existing tray.

To prevent accidental mislocation of the vote recording device 80 by inadvertant sliding out of the tray 70, one of the fore-shortened mounting means 74 is provided with latch means 84 having a detailed construction as shown in FIGS. 4–6. The latch means 84 comprises a latch member 86 pivotally secured by a pivotal member 88, such as a nut and bolt or a shoulder rivet, secured to the vertical wall 76 of the tray 70. To maintain the latch member 86 in a closed position, such as shown in FIG. 6, the outside surface 90 of the vertical wall 76 is provided with a depression 92 which is adapted to receive a dimple 94 embossed in the latch member 86. As shown in FIGS. 4 and 5, the latch member 86 has a pivotal wall 96 provided with an extension 98 terminating in a closing member 100 which is adapted to abut the vote recording device 80.

In order to prevent the unauthorized removal of the vote recording device 80 from the tray 70, the vertical wall 96 is provided with a hole 102 which registers in a spaced-apart relationship with a hole 104 in the closing member 100, as well with a hole 106 in the vertical wall 76. The alignment of all of these holes, namely, 102, 104, 106, permits the insertion therethrough of a suitable security device, such as a shackle 108 of a lock 110 shown in phantom in FIG. 5.

Referring to FIGS. 1 and 3, the top case section 30 has a pair of opposing sides 31 and 33 provided with a load bearing bulkhead. For example, side 31 is provided with a bulkhead 35 having a thickened section comprising a plurality of spaced teeth 37 separated by gullets 41. On the interior, the teeth, between the gullets 41, are heavily filled with molded material in areas 47, as best seen in FIG. 1. The bottom case section 32 is similarly provided with load bearing bulkheads.

In reference to FIG. 3, the bottom case section 32 is provided with a storage well 112 which is used for storing the leg means 114, which comprise a plurality of leg members 116 and 118 and a foot 120. The two leg members 116 and 118 possess telescopic structure so that they can be interengaged with each other to present a rigid support for the apparatus 26. The outer extremity of the leg member 116 is terminated in the foot 120 which frictionally engages within the interior of the leg member 116. The leg member 118 has an end 122 which is received by leg means receiving and positioning means in the form of a leg socket 124 established in the bottom portion of the bottom case section 32, as best viewed in FIG. 3. Most of the socket 124, as best viewed in FIG. 15, is, to a great extent, integrally molded with a vertical wall 126 and a base 128 in each corner of the bottom case section 32. Adjoining the socket 124 is a thickened arcuate section 130 as defined by a groove 132 in the base 128.

To complete the leg socket 124 configuration, there is provided, a leg socket insert 134 having an arcuate shape to complementarily engage the thickened section 130. The socket insert 134, as shown in FIGS. 16A and 16B, is provided with an upstanding arcuate wall 136 which is adapted to be inserted into the groove 132. The exterior of the arcuate wall 136 is reinforced by three transverse walls 125. The socket insert 134 is molded from appropriate plastic material and is provided with a pair of holes 138 which will register with holes 140 in the section 130 so that securing means, such as screws (not shown), may be used to attach the socket insert 134 to the section 130 to further complete the full configuration of the socket 124. The closed end of the socket 124 has a blind wall 142 provided with an opening 144 which communicates with a depression 146 defined adjacent an end of the bulwark section 42, as best seen in FIG. 1.

The socket insert 134 has an arcuate wall 137 adapted to cooperate with the vertical wall 126 in the corner of the bottom case section 32 to define therewith a partial opening or socket for admitting the leg member 118. The opening or the socket is completed by a corner insert 143 secured to the bottom case section 32 by securing members 145. The arcuate wall 137 has an arcuate edge 139 having an arc which subtends less than 180° of the circumference of the inserted leg. The corner insert 143 has an inner arcuate edge 147 having an arc which subtends more than 180° of the circumference of the inserted leg. Also, the opening defined by the edges 139 and 147 has a diameter slightly smaller than the diameter of the leg member 118. To achieve the insertion of a larger diameter leg member into a smaller diameter opening defined by the edges 139 and 147, the socket insert 134 and the corner insert 143 are injection molded from plastic materials which will exhibit a slight yield when stressed.

In order to facilitate the insertion of the leg 118 into the socket 124, the socket insert 134 is mounted slightly below the corner insert 143, so that the arcuate edge 139 of the socket insert 134 is below the arcuate edge 147 of the corner insert 143, as best viewed in FIG. 17. The foregoing arrangement provides a rigid securement for the leg 118 after it is forcefully inserted into the socket 124 to occupy an upright position, as shown in phantom view in FIG. 17.

To prevent the loss or the misplacement of the leg members 116 and 118 defining the leg means 114, the leg members are coupled together by an elastic cord 148 having one end, as shown in FIG. 3, passing through the foot 120 and terminating in a knot 150 which is adapted to be concealed within the interior of the foot 120. The other end of the elastic cord 148 passes through the socket 124 and emerges through the opening 144 in the socket and passes outwardly through the depression 146, as shown in FIG. 1, to be terminated in a knot 152. The depression 146 is deep enough to accommodate the knotted end 152 and also to accept a cover pad 154 for the purpose of concealing the knotted end. As an alternative, instead of knotting the ends of the cord 148, some form of a clip may be used.

In order to place the voting booth apparatus 26 in a storable condition, the two leg members 116 and 118 are disjointed by pulling the leg members apart and then storing the leg members in the storage well 112 which is provided with plurality of spring clips 160 capable of supporting eight disjointed leg members. The storage well 112 and the clips 160 determine the storing means for storing the leg means 114 exteriorly of the carrying case 28.

In its partially erected condition, the voting booth apparatus 26, as shown in FIG. 1, has its top case section 30 in an over-center position maintained by a stop cable 162. An inner wall 164 of the top case section 30 is provided with a mounting panel 166 provided with securing members, such as clips 167, which can be used for mounting a list of voting instructions.

The inner wall 164 is substantially encompassed by a wall 170 except in the area of the front portion 172 of the top case section 30, wherein a break or an opening exists between terminating ends 174 and 176 of the wall 170. Each of the terminating ends, such as terminating end 176, is provided with pivot means, such as pivot pins 178, adapted to pivotally support an access door 180 by engaging corresponding pivot means, for example, such as holes 181.

The interior of the access door 180 has a pair of longitudinal walls 182, 184 which are perpendicular to each other and terminate in angular wall ends 186 and 188. The wall 182 has a rectangular opening 190 and an aperture 192 for providing access to electrical components, as will be described later. Also, the access door 180 is provided with an overhanging wall 194 provided with a locking tab 196 integrally molded with the access door 180, in a median position between the angular wall ends 186 and 188. In addition to the foregoing, the overhanging wall 194 is provided with latch members 198 and 200 integrally molded with the access door 180 and adapted to interlockingly engage with the latch brackets 64 integrally molded with the bottom case section 32.

As can be seen from FIG. 1, the angular wall ends 186, 188, the longitudinal walls 82, 84, and the overhanging wall 194 define a chamber adapted to receive a light fixture 202 having a housing 203 provided with terminal brackets 204 for supporting a source of illumination such as a fluorescent lamp 206. The housing 203 is attachable by securing means, such as screws (not shown), passing through the wall 182 and threadedly engaged with the housing 203.

As has been pointed out earlier, various components of the voting booth apparatus 26 are made by a blow molding process. Therefore, it is preferable to attach the access door 180 to the top case section 30 immediately after the foregoing have been molded and are still warm so that the pivot pins 178 may be inserted into the holes 181. The foregoing also applies to the attachment of the handle 58 to the handle bracket 56, i.e., the attachment is completed shortly after molding is completed. During this time, the plastic material, such as high-density polyethylene (HDPE), is still warm, pliable and resilient. After cooling, the plastic material hardens noticeably, and the access door 180 cannot be dislocated accidentally.

As was previously mentioned, the access door 180 is independently pivotable with respect to the top case section 30, thereby permitting the insertion or the removal of voting paraphernalia or the vote recording device 80 as shown in FIG. 2.

The top case section 30, adjacent the terminating ends 174 and 176 of the wall 170, is provided with integrally molded latch members 208 and 210 which are adapted to interlock with the latch brackets 66 integrally molded with the bottom case section 32, as can be visualized from the illustration in FIG. 1.

The limit fixture 202, when assembled within the interior of the access door 180, can be better seen in FIG. 8, wherein the access door 180 is shown in an opened position providing access to the interior of the carrying case 28.

Referring to FIG. 10, the housing 203 has a push-button electric switch 212 extending out of an opening 214 in the housing 203, and a female plug receptacle 216 slightly extending out of a rectangular aperture 218 in the housing 203. On the housing 203, on a wall opposite to the wall having the switch 212, means (not shown) are provided for storing an electrical cord.

The internal wiring in the housing 203 can be understood by reference to the circuit diagram shown in FIG. 11, wherein a cord 222 terminating in a male plug 228 has its other end connected to the switch 212 having a double-pole double-break construction. The switch 212 is only used for testing purposes, namely to determine whether the fluorescent lamp 206 is in a good condition, the testing being performed with a tester 230 as shown in phantom in FIG. 10. The test is performed on the voting booth apparatus while the carrying cases 28 are stacked, for example as shown in FIG. 2, during which time, the access door 180 is still closed. The testing procedure will be described shortly. During normal use of the voting booth apparatus 26, the plug 228 is plugged into a power receptacle at the voting site or location so that electrical power is provided to the light fixture 202 by the cord 222 over a pair of movable switch elements 232 connected to the stationary switch contacts 234 and over the lines 236 to the lamp 206. Simultaneously, electrical power is conducted over lines 238 and applied to the female plug receptacle 216. With the foregoing arrangement, when a number of voting booth apparatus 26 are set up together in a group, it is only necessary to plug in the first voting booth apparatus to a wall electrical receptacle. The second voting booth apparatus is then connected to the first apparatus by inserting the plug 228 of the second apparatus into the female plug receptacle 216 on the first apparatus. Similarly, an entire series of voting booth apparatus can be electrically intercoupled with each other to provide illumination for all the booths. Since the power requirement of each voting booth apparatus 26 is small because of the efficiency of the fluorescent lighting, a whole series of voting booth apparatus can be accommodated without any problem.

Referring to the circuit diagram shown in FIG. 11, during a test, when the tester 230 is pressed against the switch 212 and the male plug (not shown) on the tester is inserted into the female plug receptacle 216, the switch 212 is actuated such that the switch elements 232 are moved over to dead switch contacts 240 to thereby render prongs 227 on the plug 228 harmless in the event that they may be touching a metallic component within the access door 180, such as the metal housing 203. Simultaneously, power is applied through the female plug receptacle 216 to the lines 238 and the lines 236 to the lamp 206. If the lamp 206 lights up, the illumination will be visible through an imperforate inspection area in the access door, as will be described more fully at a later time.

If the lamp fails to illuminate, the access door 180 is opened and the lamp can be readily removed from the access door 180 while the carrying case 28 is still in a stored condition. In the event that some other electrical problem exists in the light fixture 202, the access door 180 is opened to permit the removal of the entire light fixture 202 while the carrying case 28 is still in a stored condition.

The front view of the access door 180, as shown in FIG. 12, is provided with a rectangular aperture 242 and an opening 244 which are so positioned that they register respectively with the female plug receptacle 216 and the switch 212 on the housing 203 when the light fixture 202 is installed within the access door. The front of the access door 180 is also provided with an imperforate inspection area 246 which is formed during the molding process in such way that the area has a very thin wall through which can be viewed the illumination of the fluorescent lamp 206 during a test procedure.

The access door 180 also performs the function of immobilizing the tray 70 during a stored condition so that when the carrying case 28 is carried in a vertical position as by holding the handle 58, the tray 70 including the vote recording device 80 will not flop around in the interior of the carrying case. This immobilization can be seen from FIG. 14, wherein the access door 180 has a wall section 248 overlying the free end of the tray 70 and pressing it against the working surface 68 of the bottom case section 32.

The voting booth apparatus 26 can be erected to provide varying degrees of privacy during balloting. An adequate amount of privacy is obtained with the privacy side panels 36 and 38 when the carrying case 28 is opened and set up to the position shown in FIGS. 1 and 7. The voting booth apparatus 26 in FIG. 1, has been set up so that the bottom case section 32 is supported on a floor in a standing position by means of the leg means 114 and ready to receive the vote recording device 80 for recording the balloting. The voting booth apparatus 26 in FIG. 7 has been set up so that the bottom case section 32, instead of using the leg means 114, is supported on a surface as provided, for example, by a table top 247. As can be seen, the unused leg members 116 and 118 remain stored, during such set up, in the storage well 112. The voting booth apparatus 26 in FIG. 7 has been prepared for paper balloting by pivoting the tray 70 to a non-use position by resting the free end of the tray 70 against the inner wall 164 of the top case section 30.

During the stored condition of the voting booth apparatus 26, the side panels 36 and 38 are in overlapped position as shown in FIG. 9. When the top case section is opened up, the side panels are brought up to a vertical position, as best seen in FIG. 18. The exterior side of each side panel, for example side panel 38, is provided with a plurality of reinforcing longitudinal grooves 253 during the molding process to thereby provide lateral stability to the side panels during stored and set up positions. Furthermore, the side panels, such as side panel 38, during the molding process, receives a pair of "U"-shaped grooves 255 which laterally encompass the channel 43 which receives the curtain rod 45.

As shown in FIGS. 1 and 7, each side panel, such as side panel 36 is provided with a pair of nose-like projections 257 having upwardly angled cam surfaces 262. During the set up of the voting booth apparatus 26, after the top case section 30 is opened to an over center upright position as determined by the stop cable 162, the folded side panels 36 and 38, as shown in FIG. 9, are unfolded into upright positions, then the top case section 30 is pivoted toward the upright side panels in such manner that grooves 264 in the terminating ends 174 and 176 of the wall 170 receive the projections 257 of the respective side panels 36 and 38. The movement of the top case section 30 is continued until each projection 257 snaps into a depression 268 in the bottom of the groove 264. The function of the cam surface 262 on each projection 257 is to facilitate the disengagement of the top case section 30 from the side panels 36 and 38 during dismantling of the voting booth apparatus 26.

If additional privacy is desired, the privacy offered by the panels 36 and 38 can be extended by additional privacy means including for example curtain panels 258 and 259 supported by the curtain rod 45, as shown particularly in FIG. 18.

As has been previously described, the vote recording device 80 can be locked in its position on the tray 70 by the lock 110 as shown in FIG. 5. In the event that other materials are stored in the interior of the carrying case 28, the access door 180 can also be locked by appropriate means. Referring to FIGS. 1 and 8, the access door 180 in the closed position will have its locking tab 196 overlap the handle bracket 56 so that a hole 296 in the locking tab 196 will register with a hole 298 in the handle bracket 56 so that any form of a locking device can be used to pass through both of the holes.

There will now be described the manner of using the voting booth apparatus 26 described so far.

PRE-ELECTION PREPARATION

Since the carrying cases 28 are stacked on top of each other and the access doors 180 are closed, each light fixture 202 can be exteriorly tested with the tester 230, as previously mentioned. Next, the access door 180 is opened, the latch 86 is opened on the tray 70 and the vote recording device 80 is removed so that it can be prepared to record a particular slate of candidates and election issues. Thereafter, the vote recording device is returned into the tray, the latch 86 is closed and the access door 180 is closed. If necessary, the access door can be locked or sealed.

SET-UP PROCEDURE (AT POLLING PLACE)

Invert the carrying case 28 and remove the leg members 116, 118 from the clips 160 in the storage well 112. Erect the leg members and insert the legs into the sockets 124. Stand the booth apparatus upright. Open both sets of latch members 208, 210, 198, 200 and open the top case section 30. Vertically position the privacy side panels 36, 38, and snap the projections 257 in the depressions 268 in the top case section 30. Plug in the lamp cord 222 into a wall electrical receptacle at the polling place. If more than one voting booth apparatus is being set up, the second voting booth apparatus has its lamp cord 222 connected to the female receptacle 216 of the first voting booth apparatus. Each succeeding voting booth apparatus is similarly connected to the preceding voting booth apparatus.

If voting is done by a paper ballot, the vote recording device 80 is not used. The tray 70 is pivoted upwardly so that it rests against the top case section 30, as shown in FIG. 7, thereby making available the entire working surface 68 for supporting the paper ballot.

Although an embodiment of the invention has been described with some particularity, many modifications and variations in the invention are possible within the light of the above teachings. It is, therefore, to be understood that, within the scope of the appended claims, the invention may be practiced other than as specifically described.

What is claimed is:

1. A self-contained portable voting booth apparatus which can be used for paper and vote recording device balloting and can be readily set up at any desired voting site, comprising a carrying case having a pair of hinged top and bottom case sections, the improvement wherein said bottom case section is provided with surface means for supporting a paper ballot, including securing means mounted on said surface means for pivotally securing a vote recording device, whereby said securing means is pivotable to a non-use position whenever said apparatus is used for paper balloting.

2. A voting booth apparatus according to claim 1, wherein said top case section is provided with an opening providing access to said surface means, whereby balloting paraphernalia such as instructions, writing or marking implements, or a vote recording device may be inserted or removed while said voting booth apparatus is in a stored condition.

3. A voting booth apparatus according to claim 2, wherein said access opening is provided with a door.

4. A voting booth apparatus according to claim 3, including means on said door and on said bottom case section cooperatively defining a security device, whereby said security device can be locked to deny access to the interior of the carrying case.

5. A voting booth apparatus according to claim 3, wherein said door is provided with lighting means, and means associated with said door to indicate illumination of said lighting means, whereby, when a source of electric power is applied externally through said door to said lighting means during the stored condition of said carrying case, the illumination of said lighting means can be established without opening said access door.

6. A voting booth apparatus according to claim 2, support means for pivotally supporting the vote recording device on said surface means, whereby said support means is pivoted to a non-use position whenever said apparatus is used for paper balloting.

7. A voting booth apparatus according to claim 6, including securing means associated with said support means for securing said vote recording device on said support means, whereby said vote recording device is maintained in its secured position whether said carrying case is in a stored condition or in an erected position.

8. A voting booth apparatus according to claim 1, wherein said surface means comprises a working surface and an undersurface, said undersurface defining a planar wall, in a well, including leg means having erectably extensible leg members, and storing means associated with said planar wall for securing said leg members in said well, whereby said leg members are concealed in said well during the stored condition of the apparatus or when said apparatus is used for balloting without requiring the erection of the legs, as for example, when the apparatus is placed on the surface of a table.

9. A voting booth apparatus according to claim 8, including elastic means for permanently securing said leg members to said bottom section, whereby said elastic means permit the disassembly and the assembly of said leg means so that said apparatus can be set up in a standing position.

10. A voting booth apparatus according to claim 8, including leg member receiving and positioning means associated with said bottom case section for removably receiving said leg members when said voting booth apparatus is set up in a standing position, said leg member receiving and positioning means comprises a socket molded in said lower case section, a socket insert defining a partial perimetrical extension of said socket, and a socket reinforcing member cooperating with said socket insert to complete the perimetrical extension of said socket.

11. A self-contained portable voting booth apparatus which can be used for paper and vote recording device balloting and can be readily set up at any desired voting site, comprising a carrying case having a pair of hinged top and bottom case sections, the bottom case section being provided with a working surface for supporting a paper ballot, and securing means pivotally mounted on said working surface and adapted to receive the vote recording device, whereby said securing means is pivoted to a non-use position whenever said apparatus is used for paper balloting.

12. A voting booth apparatus according to claim 11, wherein said securing means comprises a tray supported on said working surface.

13. A voting booth apparatus according to claim 11, including leg means having erectably extensible leg members integrally coupled with said case, and means for storing said leg members exteriorly of said case.

14. A voting booth apparatus according to claim 11, including an access door, a light fixture cooperatively associated with said access door, said light fixture being provided with an internal test circuit secured to an interior of said access door, and means cooperatively associated with said access door and said light fixture presenting an electrical access exteriorly of said access door, whereby said light fixture can be tested or serviced when said carrying case is in the stored condition.

15. A voting booth apparatus according to claim 13, wherein said upper case section is provided with an access door to provide access to the interior of the carrying case during a stored condition, a light fixture provided with an internal test circuit secured to an interior of said access door, and means cooperatively associated with said access door and said light fixture presenting electrical access exteriorly of said access door, whereby said light fixture can be tested or serviced when said carrying case is in a stored condition.

16. A voting booth apparatus according to claim 13, wherein said bottom case section is provided with a well for storing said leg members, and said means for storing said leg members includes a plurality of clips for securing said stored leg members.

17. A voting booth apparatus according to claim 16, wherein each of said top and bottom case sections is provided with partial peripheral re-enforcement, whereby, when a number of carrying cases are stacked together, said re-enforcements contribute to maintaining each of said cases in a planar condition, thereby avoiding sagging and deformation in the bottommost cases.

18. A self-contained portable voting booth apparatus which can be used for paper and vote recording device balloting and can be readily set up at any desired voting site, comprising a carrying case having a pair of hinged top and bottom case sections, a pair of privacy panels connected to one of said case sections, the bottom case section being provided with a working surface for supporting a paper ballot, a tray pivotally supported on said working surface and adapted to receive the vote recording device, leg means having erectably extensible leg members permanently coupled with said case, and storing means for storing said leg members exteriorly of said case.

19. A voting booth apparatus according to claim 18, including an access door in said upper case section and a light fixture secured to an interior of said access door, and means cooperatively associated with said access door providing power input to said light fixture.

20. A voting booth apparatus according to claim 19, including an internal test circuit secured to the interior of said access door, said cooperative means presenting electrical access exterior of said access door, whereby the light fixture can be tested or serviced when said carrying case is in a stored condition.

21. A voting booth apparatus according to claim 18, wherein said bottom case is provided with an exterior well, and said means for storing said leg members comprises a plurality of clips secured in said well for supporting said leg members in said well when said case is in a stored condition.

22. A voting booth apparatus according to claim 18, wherein said top and bottom case sections are integrally molded from a high-impact plastic material, each of said case sections having at least a pair of opposing sides possessing integrally molded re-enforcements, whereby said re-enforcements preserve the physical configuration of said case when, in the stored condition, it is burdened by a number of other stacked stored cases.

23. A voting booth apparatus according to claim 18, including a stop member interconnecting said top and bottom case sections, whereby, during the erection of the voting booth apparatus, when the top and bottom sections are opened up, said stop member maintains said top section substantially in a vertical position, and means on each of said privacy panels for engaging with said top case section to maintain said top case section in a substantially vertical position when said apparatus is completely erected.

24. A self-contained portable voting booth apparatus which can be used for paper and vote recording device balloting and can be readily set up at any desired voting site, comprising a carrying case having a pair of hinged top and bottom case sections, the bottom case section being provided with a working surface for supporting a paper ballot, and a tray pivotally supported on said working surface and adapted to receive the vote recording device, whereby said tray is pivoted to a non-use position whenever said apparatus is used for paper balloting.

25. A voting booth apparatus according to claim 24, including leg means having erectably extensible leg members integrally coupled with said case, and means for storing said leg members exteriorly of said case.

26. A voting booth apparatus according to claim 24, including leg means having erectably extensible leg members integrally coupled with said case, and means for storing said leg members exteriorly of said case.

27. A voting booth apparatus according to claim 25, wherein said upper case section is provided with an access door to provide access to the interior of the carrying case during a stored condition, a light fixture provided with an internal test circuit secured to an interior of said access door, and means cooperatively associated with said access door and said light fixture presenting electrical access exteriorly of said access door, whereby said light fixture can be tested or serviced when said carrying case is in a stored condition.

28. A voting booth apparatus according to claim 25, wherein said bottom case section is provided with a well for storing said leg members, and said means for storing said leg members includes a plurality of clips for securing said stored leg members.

29. A voting booth apparatus according to claim 28, wherein each of said top and bottom case sections is provided with partial peripheral re-enforcement, whereby, when a number of carrying cases are stacked together, said re-enforcements contribute to maintaining each of said cases in a planar condition, thereby avoiding sagging and deformation in the bottommost cases.

30. A self-contained portable voting booth apparatus which can be used for paper and vote recording device balloting and can be readily set up at any desired voting site, comprising a carrying case having top and bottom case sections hinged together, said top and bottom case sections being integrally molded, the bottom case section being provided with a working surface for supporting a paper ballot and the vote recording device, said top case section having a side, opposite to the hinged side, provided with an access door, and means cooperatively associated with said access door and said bottom case section adapted to receive a security device, whereby said top and bottom case sections can be maintained in a locked condition.

31. A voting booth apparatus according to claim 30, including privacy means integrally connected to one of said case sections, and tray means pivotally secured to said working surface and adapted to secure the vote recording device to said working surface, a latch member associated with said tray means for securing said vote recording device on said tray means.

32. A voting booth apparatus according to claim 31, including leg means having erectably extensible leg members coupled with said case, and means for storing said leg members exteriorly of said case.

33. A voting booth apparatus according to claim 30, including a pair of privacy means permanently connected to one of said case sections, tray means pivotally secured to said working surface and adapted to secure the vote recording device to said working surface, and leg means having erectably extensible leg members integrally coupled with said case, and means for storing said leg members exteriorly of said case, wherein said leg means comprises a plurality of legs, each leg having a pair of said leg members, said leg members being tubular and interconnectable together, each pair of leg members being permanently secured by an elastic cord having one end secured to the bottom case section and having the other end secured to a foot terminating each pair of leg members.

34. A portable-storable voting booth apparatus which can be used for paper and vote recording device balloting, and can be readily set up at any desired voting site, comprising a carrying case having a pair of hinged top and bottom case sections, a pair of privacy panels secured to at least one such case sections, the bottom case section being provided with a working surface for supporting a paper ballot, a tray pivotably supported on said working surface and adapted to receive the vote recording device, leg means having erectably extensible leg members integrally coupled with said case, and means for storing said leg members exteriorly of said case.

35. A voting booth apparatus according to claim 34, including an access door, a light fixture provided with an internal test circuit secured to an interior of said access door, and means cooperatively associated with said access door and said light fixture presenting electrical access exterior of said access door, whereby the light fixture can be tested when said carrying case is in a stored condition.

36. A voting booth apparatus according to claim 34, wherein said tray is both pivotably and detachably supported on said working surface, whereby said tray can be detached and replaced by another tray to accommodate a different size of a vote recording device.

37. A voting booth apparatus according to claim 34, said means for storing said leg members comprises a well in a bottom of said bottom case section, at least one storage bracket provided with clips secured in said well, a plurality of sockets defined in the bottom of said bottom case section, and an elastic cord interconnecting said leg members together and secured interiorly of said sockets, whereby each leg means has a pair of leg members telescopically interengaged with each other, each clip being adapted to support a leg member.

38. A voting booth apparatus according to claim 35, said access door being provided with an inspection area, whereby during the testing of the light fixture, said inspection area will give an indication of the presence of light illumination.

39. A voting booth apparatus according to claim 35, wherein said light fixture is detachably secured to said access door, whereby in the event of a malfunction of said light fixture, the light fixture may be readily removed from the case in its stored condition.

40. A voting booth apparatus according to claim 34, said top case section being provided with a structural configuration, and said bottom case section being provided with a complementary structural configuration, whereby a plurality of carrying cases can be interengagingly stored together in a stack, the structural configurations of each case interengaging with complementary structural configurations in the adjoining stacked carrying cases.

41. A voting booth apparatus according to claim 34, including privacy assembly detachably secured to said privacy panels in their erected positions and storable in said carrying case, said privacy assembly comprising a generally "U"-shaped member detachably secured to said privacy panels, and curtain means supported from said horizontally disposed member.

42. A portable-storable voting booth apparatus which can be used for paper and vote recording device balloting and can be readily set up at any desired voting site, comprising a carrying case having a pair of hinged top and bottom case sections, a pair of privacy panels secured to one of said case sections, the bottom case section being provided with a working surface for supporting a paper ballot, a tray pivotably and detachably supported on said working surface and adapted to secure a vote recording device, and leg means having erectably extensible leg members for supporting said case on a floor surface.

43. A portable-storable voting booth apparatus which can be used for paper and vote recording device balloting and can be readily set up at any voting site, comprising a carrying case having a pair of hinged top and bottom case sections and a pair of privacy panels secured to one of said case sections, the bottom case section being provided with a working surface for supporting a paper ballot, including means on said working surface for pivotally supporting a vote recording device, leg means having erectable extensible leg members integrally coupled with said case, and means for storing said leg members exteriorly of said case, whereby said vote recording device is pivotable to a non-use position whenever said apparatus is used for paper balloting.

44. A portable-storable voting booth apparatus which can be used for paper and vote recording device balloting and can be readily set up at any desired voting site, comprising a carrying case having a pair of hinged top and bottom case sections, a pair of privacy panels hinged to one of said case sections, the bottom case section being provided with a working surface for supporting a paper ballot, tray means pivotably supported on said working surface and adapted to secure the vote recording device, leg means having erectably extensible leg members integrally coupled with said case, and means for storing said leg members within said case.

45. A voting booth apparatus according to claim 44, wherein said means for storing said leg members is in the form of a well formed exteriorly of the bottom case section.

46. A portable-storable voting booth apparatus which can be used for paper and vote recording device balloting and can be readily set up at any desired voting site, comprising a carrying case having top and bottom case sections hinged togeher, said top and bottom case sections being integrally molded, a pair of privacy panels hinged with one of said case sections, the bottom case section being provided with a working surface for supporting a paper ballot, tray means pivotably secured to said working surface and adapted to secure the vote recording device to said working surface, said top case section having one side provided with an access door adjoining the free end of said tray means, a latch member associated with said tray means for securing said vote recording device on said tray means, leg means having erectably extensible leg members integrally coupled with a bottom of said bottom case section, and storing means in the bottom of said bottom case section for storing said leg members exteriorly of said case.

47. Support means for supporting a vote recording device on a working surface in a self-contained portable voting booth apparatus defined by a carrying case, comprising an elongated member having one end terminating in a hinged means adapted to be secured to said carrying case, said elongated member having a pair of sides defining therebetween a partially enclosed channel adapted to slidably receive the vote recording device, and maintaining means associated with at least one of said sides at one end of said channel for maintaining said vote recording device in said channel.

48. The support means according to claim 47, wherein said maintaining means is provided with a pair of openings coterminous with an opening in said one side, whereby said openings may be interlocked together by a security device to prevent the removal of said vote recording device.

49. A self-contained portable voting booth apparatus which can be used for paper and vote recording device balloting and can be readily set up at any desired voting site, comprising a carrying case having a pair of hinged top and bottom case sections, the improvement wherein said bottom case section is provided with surface means for supporting a paper ballot, including securing means mounted on said surface means for pivotally supporting a vote recording device and the top case section is provided with access means communicating with the interior of said carrying case.

* * * * *